US010005534B1

(12) United States Patent
Amerling et al.

(10) Patent No.: US 10,005,534 B1
(45) Date of Patent: Jun. 26, 2018

(54) ASSEMBLIES FOR ALIGNING AND STABILIZING PORTIONS OF A COWLING ON A MARINE ENGINE

(71) Applicant: Brunswick Corporation, Lake Forest, IL (US)

(72) Inventors: Steven J. Amerling, Fond du Lac, WI (US); Timothy S. Reid, Eden, WI (US); Randall J. Poirier, Fond du Lac, WI (US); Brad J. Van Ruiswyk, Waupun, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days. days.

(21) Appl. No.: 15/413,793

(22) Filed: Jan. 24, 2017

Related U.S. Application Data

(60) Provisional application No. 62/382,466, filed on Sep. 1, 2016.

(51) Int. Cl.

| | |
|---|---|
| ***B63H 20/32*** | (2006.01) |
| ***B63H 21/36*** | (2006.01) |
| ***F02B 77/11*** | (2006.01) |
| ***F02B 61/04*** | (2006.01) |

(52) U.S. Cl.
CPC ..... *B63H 20/32* (2013.01); *F02B 61/045* (2013.01); *F02B 77/11* (2013.01)

(58) Field of Classification Search
CPC ... B63H 20/32; B63H 2020/32; F02B 61/045; F02B 77/11
USPC ..... 440/76, 77
See application file for complete search history.

(56) References Cited

U.S. PATENT DOCUMENTS

| | | | | |
|---|---|---|---|---|
| 4,600,396 A * | 7/1986 | Crane | F02B 61/045 | 292/247 |
| 4,875,883 A * | 10/1989 | Slattery | F02B 61/045 | 123/195 P |
| 5,120,248 A * | 6/1992 | Daleiden | B63H 20/32 | 292/202 |
| 6,663,450 B1 * | 12/2003 | Walczak | F02B 61/045 | 123/195 P |
| 6,682,379 B1 * | 1/2004 | Walczak | B63H 20/32 | 123/195 P |
| 6,991,500 B1 * | 1/2006 | Gulko | B63H 20/32 | 123/195 P |

(Continued)

*Primary Examiner* — Daniel V Venne
(74) *Attorney, Agent, or Firm* — Andrus Intellectual Property Law, LLP

(57) ABSTRACT

An assembly is for aligning and stabilizing first and second cowl portions on a marine engine. The assembly comprises an engagement member configured to be fixed to the first cowl portion and a retainer apparatus configured to be fixed to the second cowl portion. The retainer apparatus is configured to receive the engagement member when one of the first cowl portion and second cowl portion is moved towards the other of the first cowl portion and the second cowl portion. The retainer apparatus comprises a retainer body and opposing guide members that are pivotable with respect to the retainer body. As the retainer apparatus receives the engagement member, the engagement member engages and causes the guide members to pivot with respect to the retainer body such that the engagement member becomes sandwiched between the guide members, thus aligning and stabilizing the first and second cowl portions.

20 Claims, 5 Drawing Sheets

(56) References Cited

U.S. PATENT DOCUMENTS

| | | | | |
|---|---|---|---|---|
| 7,201,623 | B1 * | 4/2007 | Krupp | B63H 20/32<br>440/77 |
| 9,216,805 | B1 | 12/2015 | Amerling et al. | |
| 9,341,008 | B1 | 5/2016 | Amerling et al. | |

* cited by examiner

ASSEMBLIES FOR ALIGNING AND STABILIZING PORTIONS OF A COWLING ON A MARINE ENGINE

CROSS-REFERENCE TO RELATED APPLICATION

This application claims the benefit of and priority to U.S. Provisional Patent Application No. 62/382,466, filed Sep. 1, 2016, which is hereby incorporated by reference in entirety.

FIELD

The present disclosure relates to cowlings for marine engines, such as for example outboard motors.

BACKGROUND

The following U.S. patents are incorporated herein by reference, in entirety:

U.S. Pat. No. 9,216,805 discloses a cowl mounting system including one or more stabilizer fulcrums spaced between front and rear cowl mounts and preloading the cowl to provide cowl stability in the mounted condition. The stabilizer fulcrums also provide port and starboard alignment guides during assembly.

U.S. Pat. No. 9,341,008 discloses a hinge assembly for a cowl of an outboard motor. The hinge assembly is configured to connect a first portion of the cowl to a second portion of the cowl. The hinge assembly comprises an arm that is connected to one of the first and second cowl portions and a retainer that is connected to the other of the first and second cowl portions. The arm is movable with respect to the retainer between a registered position wherein the arm is retained by and pivotable with respect to the retainer to thereby pivotably connect the first portion of the cowl to the second portion of the cowl and an unregistered position wherein the arm is separated from the retainer so that the first portion of the cowl is separated from the second portion of the cowl.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

An assembly is for aligning and stabilizing first and second cowl portions on a marine engine. The assembly comprises an engagement member configured to be fixed to the first cowl portion and a retainer apparatus configured to be fixed to the second cowl portion. The retainer apparatus is configured to receive the engagement member when one of the first cowl portion and second cowl portion is moved towards the other of the first cowl portion and second cowl portion. The retainer apparatus comprises a retainer body and opposing guide members that are pivotable with respect to the retainer body. As the retainer apparatus receives the engagement member, the engagement member engages and causes the guide members to pivot with respect to the retainer body such that the engagement member becomes sandwiched between the guide members, thus aligning and stabilizing the first and second cowl portions with respect to each other.

BRIEF DESCRIPTION OF THE DRAWINGS

The present disclosure is described with reference to the following drawing figures. The same numbers are used throughout the drawing figures to reference like features and like components.

DETAILED DESCRIPTION OF THE DRAWINGS

Figure 1:
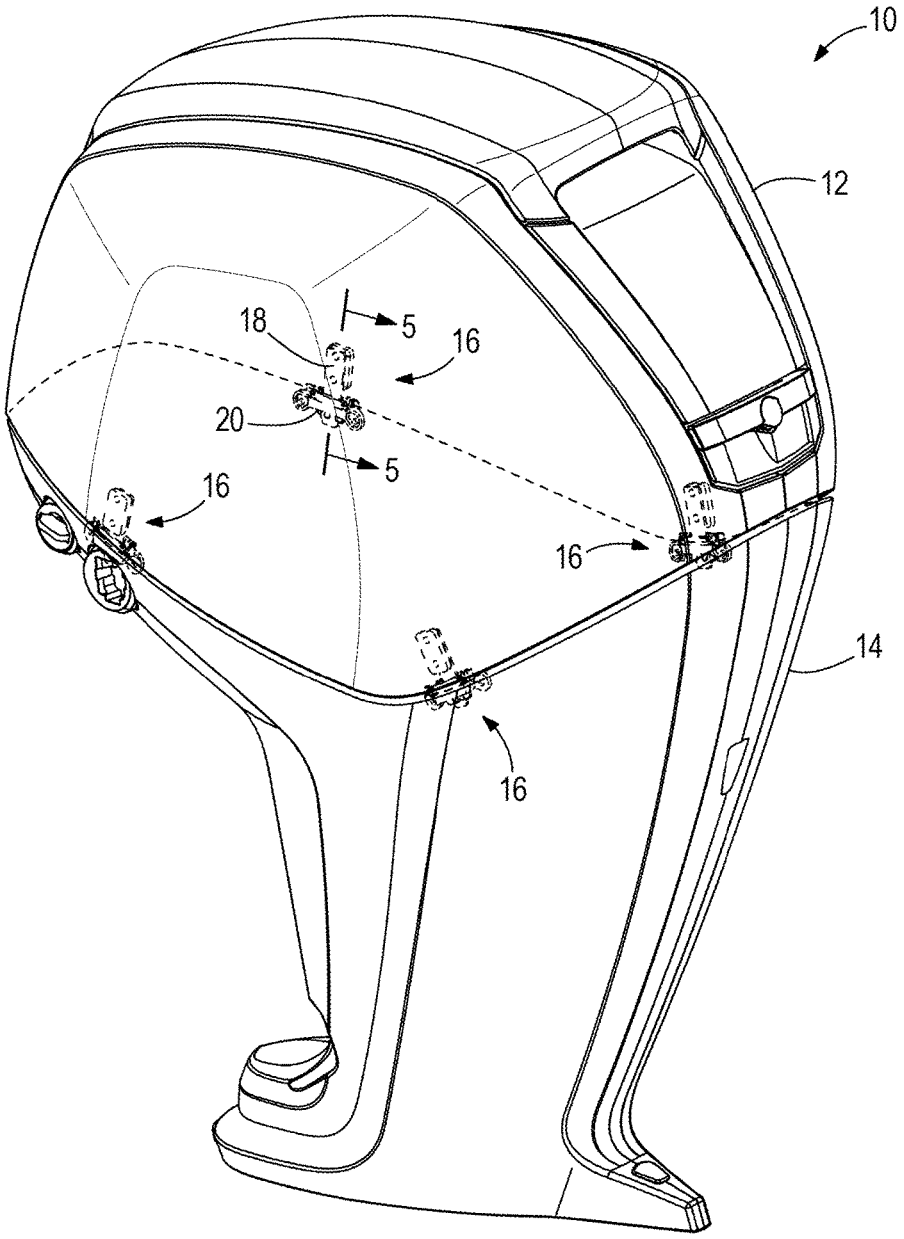
FIG. 1 is a perspective view of a cowling for an outboard motor. Four assemblies according to the present disclosure for aligning and stabilizing portions of the cowling are shown in dashed line format.

FIG. 1 depicts a cowling 10 for an outboard motor. The cowling 10 has a top cowl portion 12 and a bottom cowl portion 14 which together enclose an internal combustion engine and other components associated with the outboard motor. The appearance and configuration of the cowling 10 is exemplary and can vary from that which is shown.

FIG. 1 depicts four assemblies 16 for aligning and stabilizing the top and bottom cowl portions 12, 14 with respect to each other. Each assembly 16 is shown in dashed line format. The assemblies 16 are located around a perimeter of the top and bottom cowl portions 12, 14. Each assembly 16 includes an engagement member 18 that is fixed to the top cowl portion 12 and a retainer apparatus 20 that is fixed to the bottom cowl portion 14. As further described herein below, the retainer apparatus 20 is configured to receive the engagement member 18 when the top cowl portion 12 is moved towards the bottom cowl portion 14 to enclose the internal combustion engine associated with the outboard motor. The number and location of assemblies 16 is exemplary and can vary from that which is shown. The orientation of the engagement member 18 and retainer apparatus 20 is exemplary and can vary from that shown. For example, the engagement member 18 can be fixed to the bottom cowl portion 14 and the retainer apparatus 20 can be fixed to the top cowl portion 12.

Figure 2:
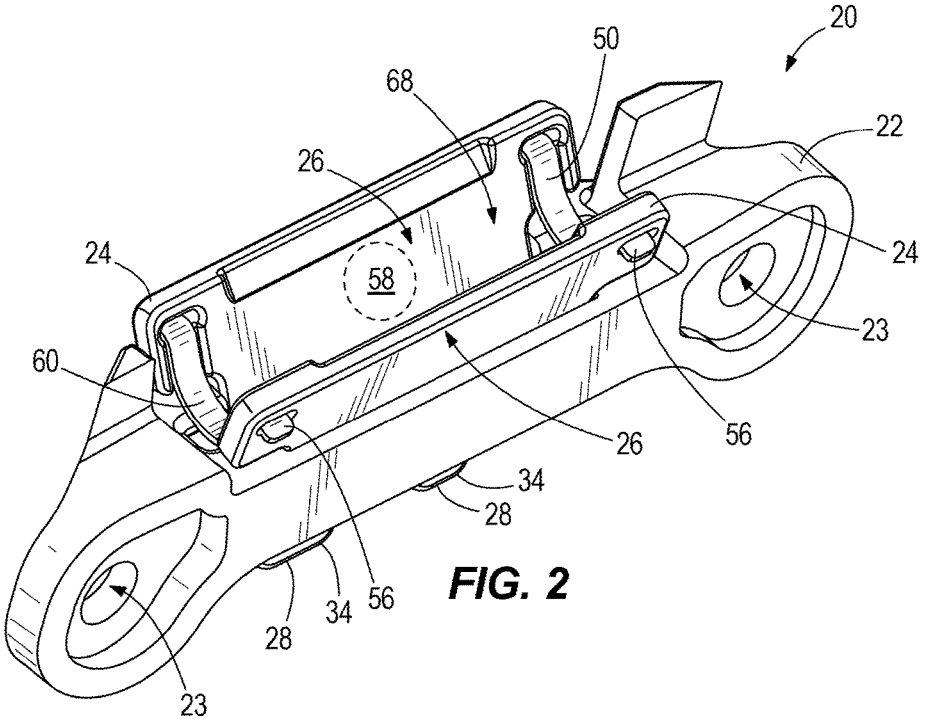
FIG. 2 is a top perspective view of a retainer apparatus according to the present disclosure.
Figure 3:
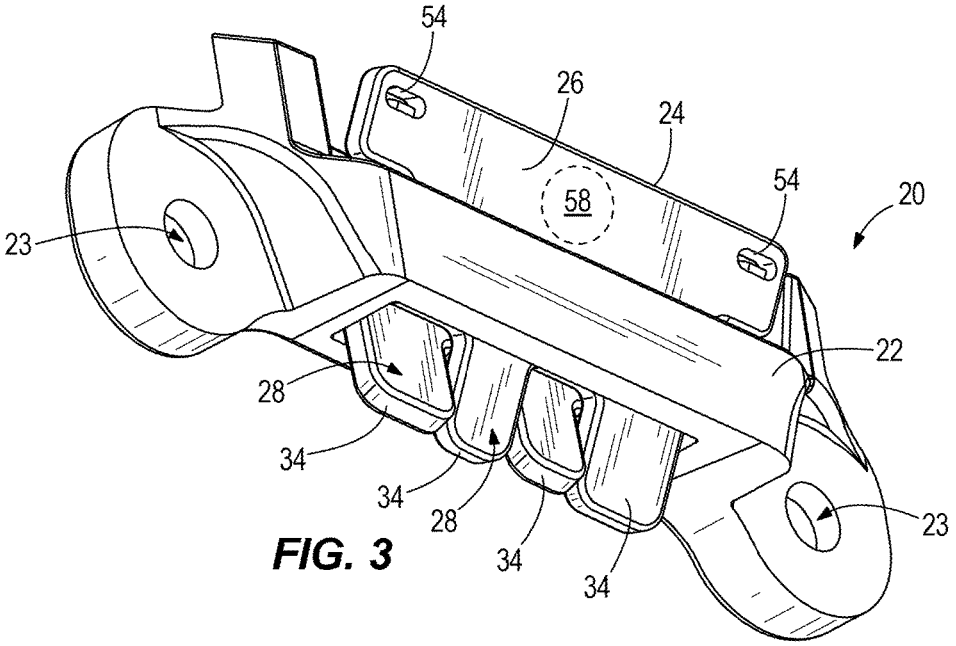
FIG. 3 is a bottom perspective view of the retainer apparatus.
Figure 4:
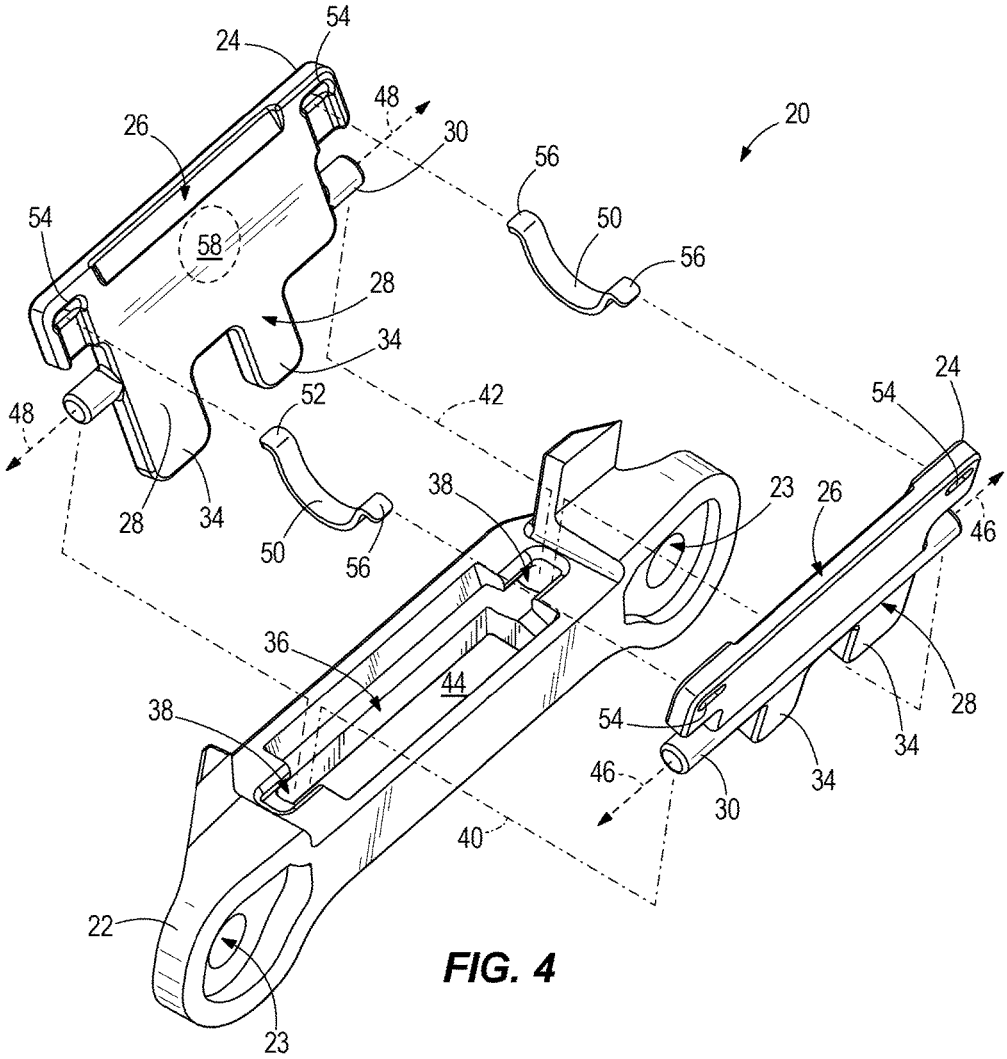
FIG. 4 is an exploded view of the retainer apparatus.

FIGS. 2-4 depict the retainer apparatus 20 in further detail. The retainer apparatus 20 includes a retainer body 22 and opposing guide members 24 that are pivotable with respect to the retainer body 22. The configuration of the retainer body 22 and the guide members 24 can vary from that which is shown, as long as the guide members 24 are pivotable with respect to the retainer body 22, as further explained herein. In the illustrated example, each opposing guide member 24 has an upper portion 26, a lower portion 28, and a pivot pin 30 disposed between the upper portion 26 and the lower portion 28. The upper portion 26 defines an inwardly oriented engagement surface. The lower portion 28 has tabs 34. The retainer body 22 has mounting holes 23 by which fasteners (not shown) extend to fix the retainer body 22 to the bottom cowl portion 14. This is merely exemplary and the manner in which the retainer body 22 is fixed to the bottom cowl portion 14 can vary from that shown. The retainer body 22 defines a channel 36 (FIG. 4) through which the guide members 24 vertically extend, as shown in FIGS. 2-3. The configuration of the channel 36 can vary from that which is shown. In the illustrated example, referring to FIG. 4, the retainer body 22 defines an expanded channel inlet 38 that is sized and shaped to receive the pivot pins 30 of the guide members 24 during assembly, as shown by dashed and dot lines 40 and 42. The retainer body 22 also defines a channel outlet 44 (FIG. 4) that is sized smaller in length than the pivot pins 30 so as to retain the pivot pins 30 in the channel 36. Again, this is exemplary and the manner in which the guide members 24 are pivotably retained with respect to the retainer body 22 can vary. For example, the channel 36 can alternately be configured so that the pivot pins 30 are assembled in the retainer body 22 via the channel outlet 44 and then retained therein by fasteners or base supporting members. In any event, once assembled, as shown in FIGS. 2 and 3, the pivot pins 30 are retained inside the channel 36 such that the guide members 24 are pivotable with respect to the retainer body 22. In the illustrated example, the guide members 24 are pivotable with respect to the retainer body 22 about pivot axes 46, 48 defined by the pivot pins 30. The tabs 34 of each respective opposing guide member 24 protrude out through the channel outlet 44 and are shown interdigitated amongst the tabs 34 of the other respective guide member 24 when the guide members 24 are transversely oriented to each other.

Optionally, springs 50 are disposed between the upper portions 26 of the respective guide members 24. The number, type and configuration of the springs 50 can vary from that which is shown. In the illustrated example, the springs 50 are leaf springs having a first end 52 connected to a recess 54 in one of the opposing guide member 24 and an opposite, second end 56 connected a recess 54 to the other opposing guide member 24. The springs 50 have a natural resiliency, i.e. the leaf springs 50 are flexible but tend to retain the shape shown in FIG. 4. The springs 50 are sized and shaped so as to naturally bias the upper portions 26 of the guide members 24 apart, into the transverse orientation shown in FIGS. 2 and 3. In other examples, the springs 50 could be torsion springs.

Optionally, magnets 58 are disposed on the upper portions 26 of the respective guide members 24. The magnets 58 are aligned with each other so that their like poles repel each other and tend to bias the upper portions 26 of the guide members apart, into the transverse orientation shown in FIGS. 2 and 3. The magnets 58 can be formed into the upper portions 26 of the guide members 24, or can be attached to the upper portions 26 of the guide members 24, or can constitute the upper portions 26 of the opposing guide member 24. The magnets 58 can be provided in addition to or in place of the above-noted springs 50.

Figure 5:
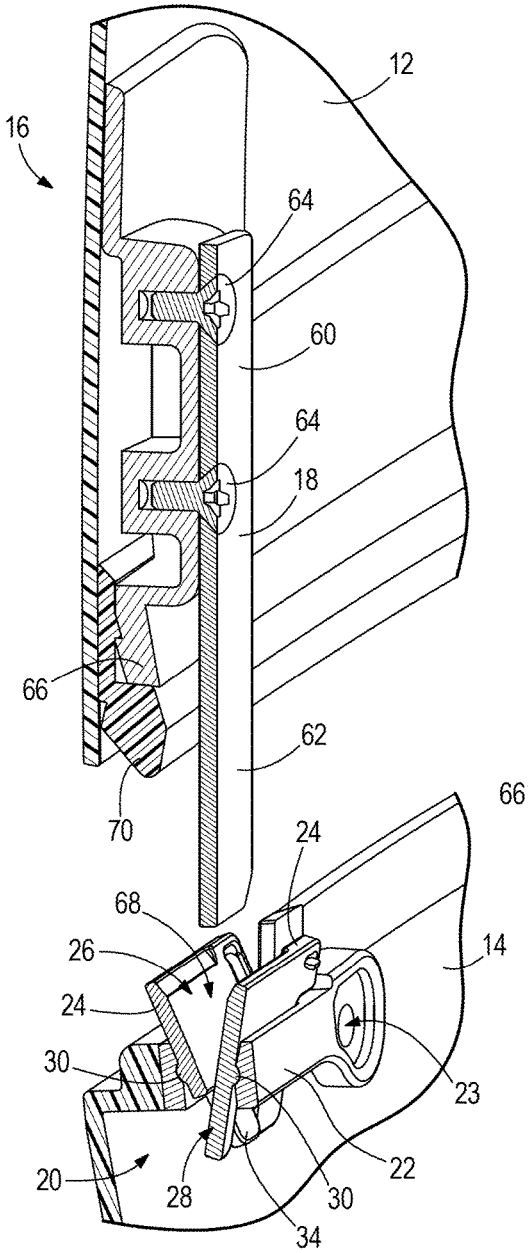
FIG. 5 is a sectional view taken along line 5-5 in FIG. 1, depicting an engagement member spaced apart from the retainer apparatus.

Referring to FIG. 5, the engagement member 18 has a first end 60 attached to the top cowl portion 12 and a second end 62 that is received by the retainer apparatus 20. Fasteners 64 extend through the first end 60 and through a mounting bracket 66 to thereby fix the first end 60 to the mounting bracket 66. The mounting bracket 66 is adhered to the top cowl portion 12. The way in which the engagement member 18 is fixed to the top cowl portion 12 is exemplary and can vary from that which is shown.

Figure 6:
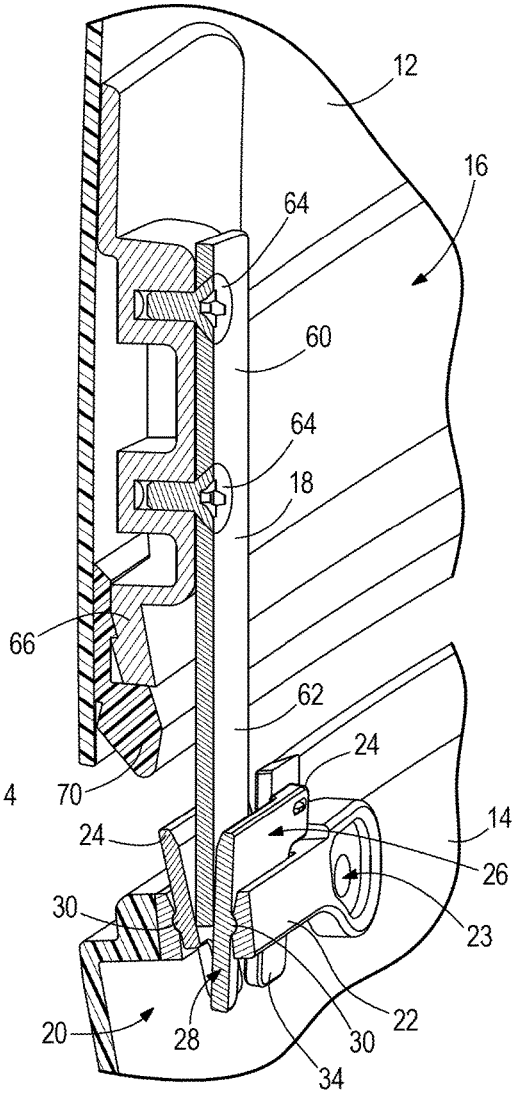
FIG. 6 is a view like FIG. 5, showing the engagement member as it is being received by the retainer apparatus.
Figure 7:
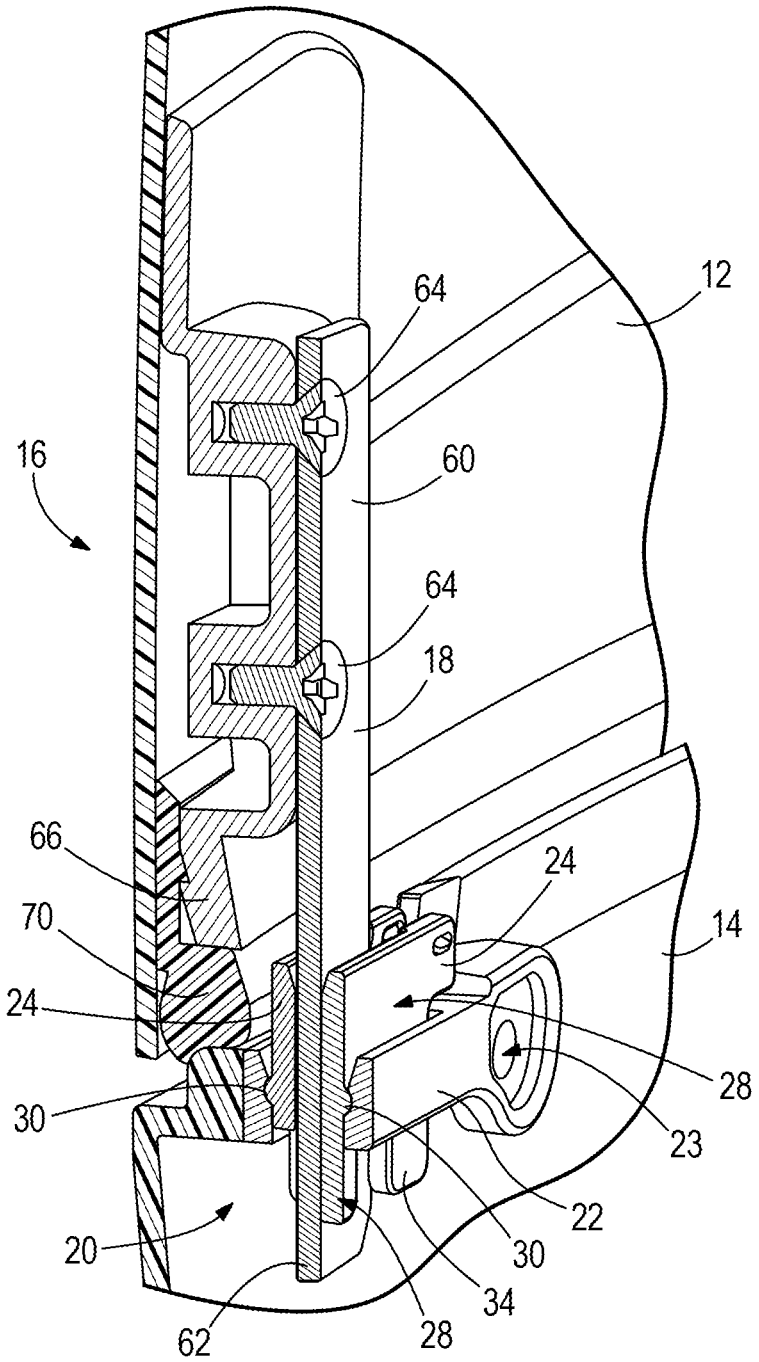
FIG. 7 is a view like FIG. 5, showing the engagement member after it has been received by the retainer apparatus.

FIGS. 5-7 depict operation of the assembly 16 as the top cowl portion 12 is progressively moved towards the bottom cowl portion 14 to enclose the internal combustion engine of the outboard motor. In FIG. 5, the leaf springs 50 and/or magnets 58 are biasing the upper portions 26 apart from each other so that a receiving channel 68 having a V-shaped cross section is formed by the upper portions 26 of the guide members 24. In this position, the tabs 34 on the lower portions 28 are interdigitated with each other. Comparing FIG. 6 to FIG. 5, the top cowl portion 12 has been progressively moved towards the bottom cowl portion 14 so that the second end 62 of the engagement member 18 engages the guide members 24, particularly along the upper portions 26, which funnel the engagement member 18 to a position between the pivot pins 30 of the guide members 24 at a center of the receiving channel 68. Comparing FIG. 7 to FIG. 6, the top cowl portion 12 has been progressively moved toward the bottom cowl portion 14, which causes the second end 62 of the engagement member 18 to pass between and past the pivot pins 30. This causes the guide members 24 to pivot about the pivot axes 46, 48 and move (e.g. snap) into the illustrated parallel alignment with each other, with the engagement member 18 being sandwiched there between. Further pivoting movement of the guide members 24 past parallel is prevented by engagement between the upper portions 26 of the guide members 24 and the opposite side surfaces of the engagement member 18 and/or engagement between the back side surfaces of the tabs 34 and the retainer body 22 along the channel outlet 44.

Funneling of the second end 62 of the engagement member 18 into the registered position shown in FIG. 7 advantageously forces the top cowl portion 12 (via the fixed engagement between the top cowl portion 12 and first end 60 of the engagement member 18) to move into alignment with and become stabilized with respect to the bottom cowl portion 14. As shown in FIG. 7, proper alignment between the top and bottom cowl portions 12, 14 promotes effective sealing along the perimeters of the top and bottom cowl portions 12, 14, for example via a perimeter seal 70. In this example, the perimeter seal 70 is retained with respect to the top cowl portion 12 via the mounting bracket 66; however the type and configuration of the perimeter seal 70 can vary from that which is shown.

When the top cowl portion 12 is removed from the bottom cowl portion 14, the assembly 16 operates in reverse order. The second end 62 of the engagement member 18 is withdrawn from the receiving channel 68, allowing the bias of the springs 50 and/or magnets 58 to force the upper portions 26 of the guide members 24 apart from each other into the transverse orientation shown in FIG. 5.

In the present description, certain terms have been used for brevity, clarity, and understanding. No unnecessary limitations are to be inferred therefrom beyond the requirement of the prior art because such terms are used for descriptive purposes and are intended to be broadly construed. The different assemblies and method steps described herein may be used alone or in combination with other assemblies and methods. It is to be expected that various equivalents, alternatives and modifications are possible within the scope of the appended claims.

What is claimed is:

1. An assembly for aligning and stabilizing first and second cowl portions on a marine engine, the assembly comprising:

an engagement member; and a retainer apparatus;

wherein the retainer apparatus receives the engagement member when one of the first cowl portion and second cowl portion are brought together;

wherein the retainer apparatus comprises a retainer body and opposing guide members that are pivotable with respect to the retainer body; and wherein as the retainer apparatus receives the engagement member, the engagement member engages and causes the opposing guide members to pivot with respect to the retainer body such that the engagement member becomes sandwiched between the opposing guide members, thus aligning and stabilizing the first and second cowl portions with respect to each other.

2. The assembly according to claim 1, wherein the opposing guide members receive and funnel the engagement member into a registered position in which the engagement member is sandwiched between the opposing guide members.

3. The assembly according to claim 2, wherein the opposing guide members are biased into a transverse orientation with respect to each other prior to engagement by the engagement member.

4. The assembly according to claim 3, further comprising a spring that biases the opposing guide members into the transverse orientation.

5. The assembly according to claim 4, wherein the spring comprises a leaf spring.

6. The assembly according to claim 3, further comprising magnets that repel each other to thereby bias the opposing guide members into the transverse orientation.

7. The assembly according to claim 6, wherein the magnets form at least part of the opposing guide members.

8. The assembly according to claim 2, wherein the opposing guide members have lower portions that are interdigitated with each other when the engagement member is in the unregistered position.

9. The assembly according to claim 8, wherein the lower portions each have tabs that are interdigitated with each other.

10. The assembly according to claim 1, wherein the engagement member has a first end that is coupled to the first cowl portion and a second end that is received by the retainer apparatus.

11. The assembly according to claim 10, wherein the second end of the engagement member engages inwardly oriented surfaces of the opposing guide members as the one of the first cowl portion and second cowl portion are brought together.

12. The assembly according to claim 11, wherein the opposing guide members are pivotable about respective pivot axes, and wherein the second end of the engagement member engages the opposing guide members and causes the opposing guide members to pivot about the respective pivot axes.

13. The assembly according to claim 1, wherein the first cowl portion comprises a top cowl portion and wherein the second cowl portion comprises a bottom cowl portion.

14. An assembly for aligning and stabilizing first and second cowl portions on a marine engine, the assembly comprising:

an engagement member;

a retainer apparatus comprising opposing guide members that pivot when engaged by the engagement member;

wherein a receiving channel is defined between the opposing guide members for receiving the engagement member when the first cowl portion and second cowl portion are brought together; and wherein the opposing guide members are configured to funnel the engagement member into a center of the receiving channel as the opposing guide members are caused to pivot and sandwich the engagement member there between, thus aligning and stabilizing the first and second cowl portions with respect to each other.

15. The assembly according to claim 14, wherein the receiving-channel has a V-shaped cross-section prior to engagement of the opposing guide members by the engagement member.

16. The assembly according to claim 14, wherein the opposing guide members have upper portions that are biased apart from each other prior to engagement of the opposing guide members by the engagement member.

17. The assembly according to claim 16, further comprising magnets that repel each other to thereby bias the upper portions of the opposing guide members apart from each other.

18. The assembly according to claim 14, wherein the engagement member comprises a first end that is coupled to the first cowl portion and a second end that is received by the retainer apparatus.

19. The assembly according to claim 18, wherein the second end of the engagement member engages the opposing guide members and become sandwiched there between.

20. The assembly according to claim 19, wherein the opposing guide members are pivotable about respective pivot axes, and wherein the second end of the engagement member engages the opposing guide members and causes the opposing guide members to pivot about the respective pivot axes.

* * * * *